US006918373B1

(12) United States Patent
Wilker

(10) Patent No.: US 6,918,373 B1
(45) Date of Patent: Jul. 19, 2005

(54) SINGLE WIRE CONTROL METHOD FOR ELECTRONIC THROTTLE SYSTEMS

(75) Inventor: Robert J. Wilker, Macomb, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 10/802,904

(22) Filed: Mar. 17, 2004

(51) Int. Cl.[7] ..... F02D 41/00
(52) U.S. Cl. ..... 123/361; 123/399; 318/254
(58) Field of Search ..... 123/361, 399, 123/396; 318/254–279

(56) References Cited

U.S. PATENT DOCUMENTS 3,630,304 A * 12/1971 Sahinkaya ..... 180/179
4,941,444 A 7/1990 Fujita
5,002,028 A 3/1991 Arai et al.
5,088,461 A 2/1992 Ohashi et al.
5,261,025 A * 11/1993 Post et al. ..... 388/811
5,333,584 A 8/1994 Kamio et al.
5,374,881 A * 12/1994 Post et al. ..... 318/373
5,406,920 A 4/1995 Murata et al.
5,447,133 A 9/1995 Kamio et al.
5,606,950 A 3/1997 Fukiwara et al.
5,669,351 A 9/1997 Shirai et al.
5,669,353 A 9/1997 Shirai et al.
5,828,193 A 10/1998 Furuta
5,950,597 A 9/1999 Kamio et al.
6,055,960 A 5/2000 Marumoto et al.
6,067,960 A 5/2000 Watanabe et al.
6,253,733 B1 7/2001 Marumoto et al.
6,289,874 B1 9/2001 Keefover
6,345,603 B1 2/2002 Abboud et al.
6,390,064 B2 5/2002 Marumoto et al.
6,511,397 B2 1/2003 Glab et al.
6,519,513 B2 2/2003 Nakagawa et al.
6,622,080 B2 9/2003 Yang et al.
6,733,350 B2 * 5/2004 Iida et al. ..... 440/84
2002/0043242 A1 4/2002 Ikeda et al.
2002/0189590 A1 12/2002 Nakagawa et al.

* cited by examiner

*Primary Examiner*—John T. Kwon
(74) *Attorney, Agent, or Firm*—Brinks Hofer Gilson & Lione

(57) ABSTRACT

The present invention provides a system and method for controlling the position of a motorized throttle assembly. The system includes a controller, a motor, throttle position sensors, driver, and a motor. A pulse width modulator is included in the controller to generate a control signal. The motor driver receives the signal and manipulates the motor to control the position of the throttle based on the signal. The control signal includes a magnitude component corresponding to a change in the throttle position, a direction component corresponding to the direction of the change in the throttle position, and a disable command component providing the ability to disable the motor. All three components are combined in a single signal.

34 Claims, 2 Drawing Sheets

SINGLE WIRE CONTROL METHOD FOR ELECTRONIC THROTTLE SYSTEMS

BACKGROUND

1. Field of the Invention

The present invention generally relates to an electronic throttle control system.

2. Description of Related Art

Electronic throttle control systems for positioning a throttle plate of a throttle body assembly are well known in the automotive industry. These systems typically employ a three phase motor driver within the throttle body itself and use three separate signals for positioning the throttle plate. Typically these signals are a magnitude signal, a direction signal, and a motor driver disable signal, all of which are sent from the controller over three conductors to the motor driver. In general, it is desirable to reduce the number of conductors in a wire harness thereby making the harness more-physically robust and more cost effective.

In view of the above, it is apparent that there exists a need for an improved system and method to communicate within an electronic throttle control system.

SUMMARY

In satisfying the above need, as well as overcoming the enumerated drawbacks and other limitations of the related art, the present invention provides a system for controlling a motorized throttle. The system includes a controller, a motor driver, a motor, and throttle position sensors. A pulse width modulator is included in the controller to generate a signal to control the throttle. The motor driver receives the signal and manipulates the motor based on the signal. Coupled to the throttle body assembly, the motor controls the position of the throttle plate based on an output from the motor driver. The signal generated by the controller includes a magnitude component, a direction component, and a disable command component. The magnitude component corresponds to a change in the throttle position. The direction component corresponds to the direction of the change in the throttle position. The disable command component provides the ability to disable the motor. All three components are combined in a single signal.

In another aspect of the present invention, the duty cycle frequency is based on the magnitude component, the direction component, and/or the disable command component. The signal has first and second duty cycle ranges that correspond to opening or closing the throttle. The specific duty cycle within these ranges correspond to the magnitude component. The disable command component is communicated through a third and fourth duty cycle. While the third duty cycle is higher than the first and second duty cycle ranges, the fourth duty cycle is lower than both the first and second duty cycle ranges. Utilizing the duty cycle encoding described, the signal can be provided from the controller to the motor driver using a single conductor.

Further objects, features and advantages of this invention will become readily apparent to persons skilled in the art after a review of the following description, with reference to the drawings and claims that are appended to and form a part of this specification.

DETAILED DESCRIPTION

Figure 1:
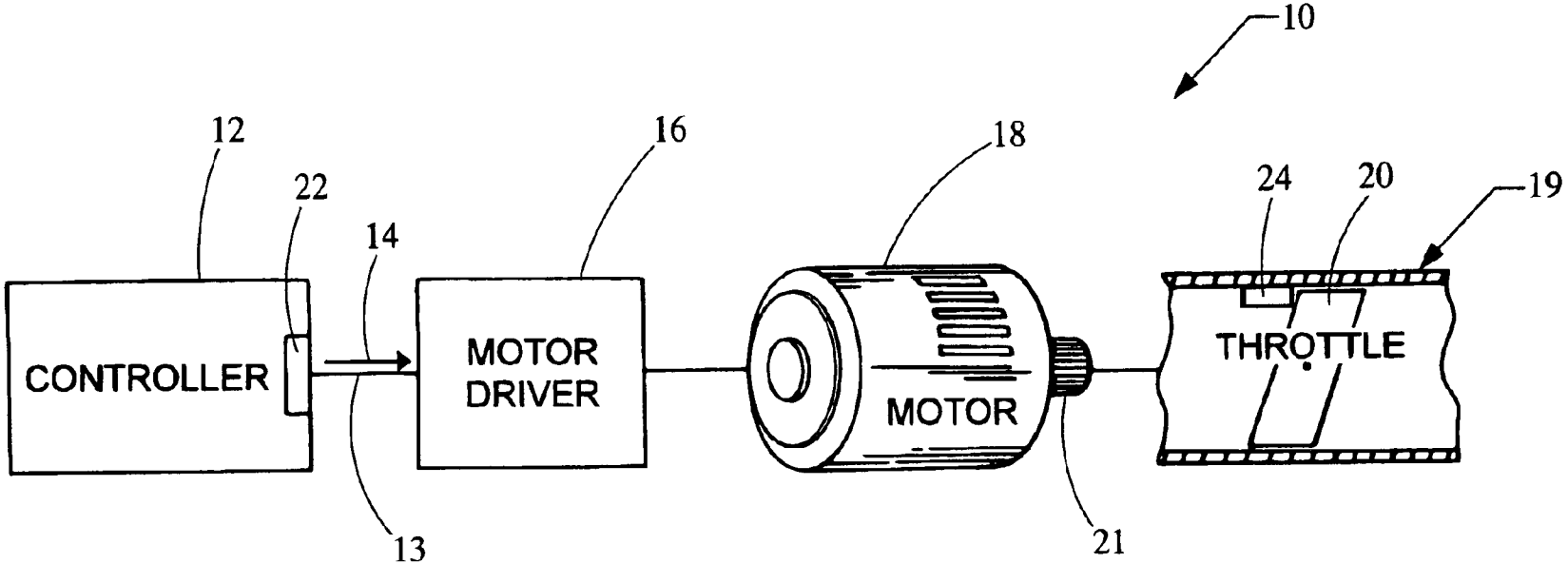
FIG. 1 is a schematic view of an embodiment of an electronic throttle control system in accordance with the present invention.

Now referring to FIG. 1, a system embodying the principles of the present invention is illustrated therein and designated at 10. The system 10 generally includes a controller 12, a motor driver 16, a motor 18, a throttle body assembly 19 having a throttle plate 20, and throttle position sensors 24.

To determine the proper throttle plate position, the controller 12 monitors various vehicle parameters. The controller 12 communicates to the motor driver 16 over a wire harness 13. Previously, such wire harnesses 13 conducted many signals and spanned a distance of many feet. To reduce the number of conductors in the wire harness 13, in the present invention the controller 12 generates a control signal, designated at 14, that includes a magnitude component, a direction component, and a disable command component, all over a single signal conductor. The motor driver 16 receives the control signal 14, interprets the signal 14 to determine the magnitude component, direction component and disable command component and uses these components to drive the motor 18, thereby manipulating the throttle plate 20 into the desired position through rotation of the motor's output shaft 21. The throttle position sensors 24 provide feedback to controller 12 indicating the throttle plate position.

In one aspect of the present invention, the magnitude component, the direction component, and the disable command component are encoded in the duty cycle of the control signal 14. To achieve this, the controller 12 includes a pulse width modulator 22 that encodes the control signal 14 utilizing four duty cycle ranges. Although other duty cycle ranges may be used, the various duty cycle ranges are provided herein for the purposes of example only.

The first duty cycle range and second duty cycle range are used to encode the direction to drive the throttle plate 20. The first duty cycle range is between 1% and 50% duty cycle. If the signal is within the duty cycle range, the motor driver 16 interprets this as driving the throttle plate 20 in an opening direction. The magnitude of torque to drive the throttle plate 20 is based on the specific duty cycle percentage between 1% and 50%. For instance, 40% duty cycle would open the throttle plate more than a 30% duty cycle by controlling the amount of torque to the motor 18. Similarly, if the duty cycle is between 51% and 99%, the motor driver 16 drives the throttle plate 20 in a closing direction by the magnitude of torque pertaining to the particular duty cycle percentage. So that electrical noise will not cause the misinterpretation of the control signal, the duty cycle ranges may have a buffer region at both ends. Final position is determined based on closed loop feedback from the throttle position sensors 24.

A third and fourth duty cycle, corresponding to about 0% or about 100%, respectively, is used as a disable command signaling the motor driver 16 to turn off power to the plate positioning motor 18. In this situation, the throttle plate 20 goes to a predetermined default position to provide operation of the vehicle in a "limp home" mode. Further, a fault condition could occur if the command from the pulse width modulator was shorted to a battery or ground.

Figure 2:
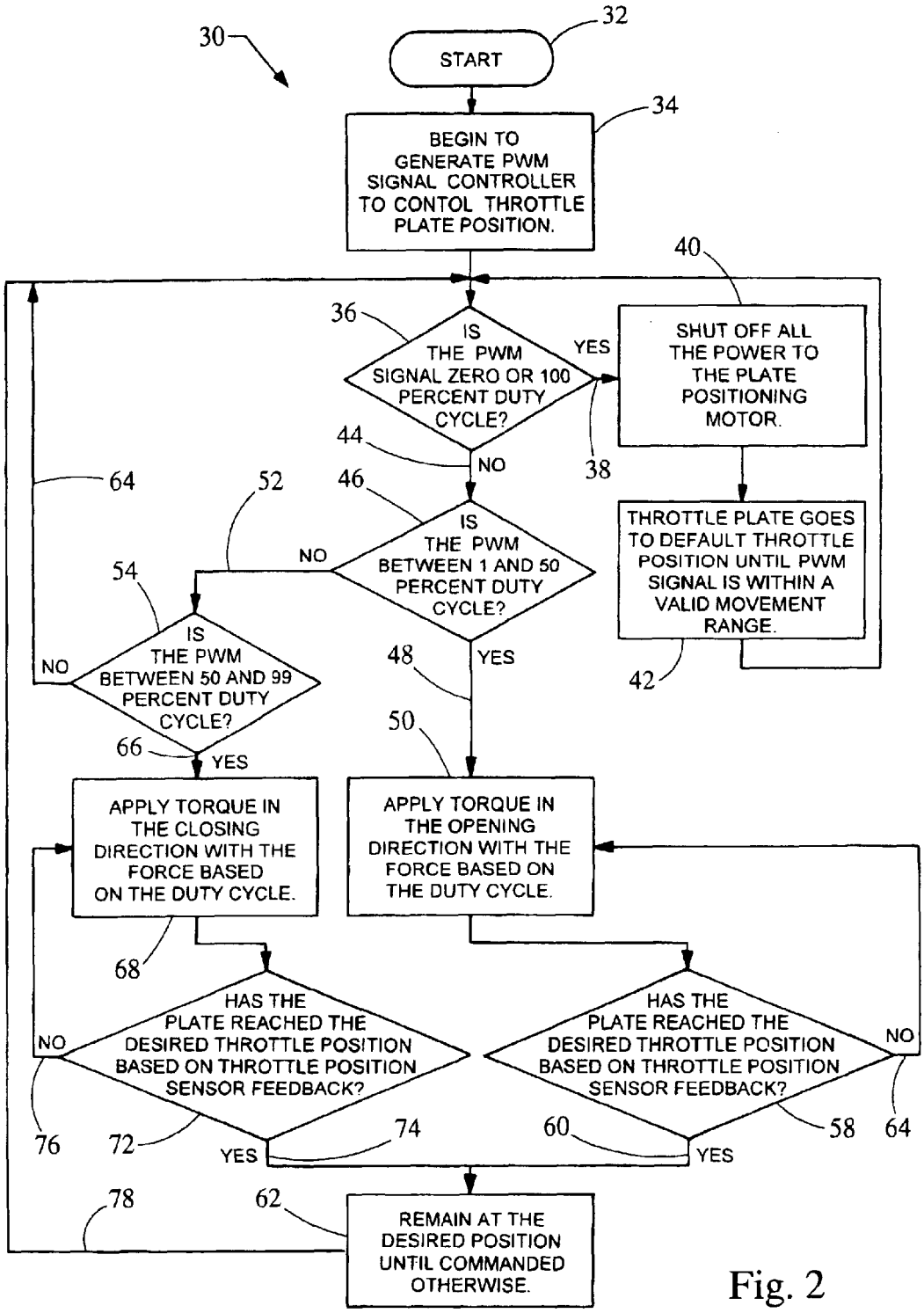
FIG. 2 is a flow chart of an electronic throttle control method in accordance with the present invention.

Now referring to FIG. 2, a method for interpreting an electronic throttle control signal is provided. The method start is denoted by block 32. In block 34, the controller 12 begins to pulse width modulate signal 14 to control the throttle plate position. The motor driver 16 determines if the signal 14 has a duty cycle of 0% or 100%, as denoted by block 36. If the signal 14 has a duty cycle of 0% or 100%, the method flows along line 38 and the motor driver 16 shuts off all power to the motor 18, as denoted by block 40. Further, the throttle plate 20 goes to the default throttle position until the signal 14 from the pulse width modulator 22 is within a valid movement range, as denoted by block 42. As a result, the method flows back to block 36 where the motor driver 16 again determines if the signal 14 is 0% or 100% duty cycle. If the signal 14 is not 0% or 100% duty cycle, the method flows along line 44 to block 46. In block 46, the motor driver 16 determines if the signal 14 is between 1% and 50% duty cycle. If the signal 14 is between 1% and 50% duty cycle, the method flows along line 48 and the motor 18 applies a torque in the opening direction with a force based on the duty cycle percentage as denoted by block 50. Further, when the throttle plate 20 has reached the desired position, based on a throttle position sensor feedback as denoted in block 58, the process flows along line 60 and the throttle plate 20 remains in the desired position until commanded otherwise as denoted by block 62. However, if the throttle plate 20 has not reached the desired throttle position based on the throttle position sensor feedback as denoted in block 58, the method follows along line 64, and the motor 18 applies further torque in the opening direction to open the throttle plate 20 as denoted by block 50.

Referring back to block 46, if the signal 14 is not between 1% and 50% duty cycle, the method flows along line 52 and the motor driver 16 determines if the pulse width modulator 22 is between a 50% and 99% duty cycle, as denoted in block 54. If the signal 14 is not between a 50% and 99% duty cycle, the method flows along line 64 and the motor driver 16 reevaluates the signal 14 in block 36. Otherwise, if the signal 14 is between 50% and 99% duty cycle, the method flows along line 66 and the motor 18 applies a torque in the closing direction with a force based on the duty cycle percentage as denoted in block 68. As shown in block 72, if the throttle plate 20 has reached the desired throttle position based on the throttle position sensor feedback, the method follows line 74 and the throttle plate 20 remains at the desired position until commanded otherwise as denoted in block 62. Alternatively, if the throttle plate 20 has not reached the desired throttle position based on the throttle position sensor feedback, the method flows along line 76 in a feedback loop and torque is applied in the closing direction as denoted by block 68. Further, as denoted by block 62, the method flows along line 78 and the signal 14 continues to be evaluated as denoted by block 36.

As a person skilled in the art will readily appreciate, the above description is meant as an illustration of implementation of the principles of this invention. This description is not intended to limit the scope or application of this invention in that the invention is susceptible to modification, variation and change, without departing from spirit of this invention, as defined in the following claims.

I claim:

1. A system for controlling throttle position comprising:

a throttle assembly having a throttle plate movable between open and closed positions;

a motor coupled to the throttle plate to control a position of the throttle plate;

a controller having a pulse width modulator configured to generate a control signal;

a motor driver electrically coupled to the controller to receive the control signal therefrom and manipulate the motor based on the control signal;

wherein the control signal includes a magnitude component corresponding to an amount of change in throttle position, a direction component corresponding to a direction of the change in the throttle position, and a disabled component providing the ability to disable the motor.

2. The system according to claim 1, wherein the magnitude component of the control signal is based on a duty cycle range.

3. The system according to claim 1, wherein the direction component of the control signal is based on a duty cycle range.

4. The system according to claim 1, wherein the disabled component of the control signal is based a duty cycle range.

5. The system according to claim 1, wherein the motor driver is configured to drive the motor in the first direction if the control signal has a duty cycle within a first duty cycle range.

6. The system according to claim 5, wherein the motor driver is configured to drive the motor in a second direction if the control signal has a duty cycle within a second duty cycle range.

7. The system according to claim 6, wherein the second duty cycle range contains a lowest duty cycle that is greater than a highest duty cycle included in the first duty cycle range.

8. The system according to claim 5, wherein the first duty cycle range is about 1–50% duty cycle.

9. The system according to claim 6, wherein the second duty cycle range is about 50–99% duty cycle.

10. The system according to claim 6, wherein the motor driver is configured to disable the motor, if the duty cycle of the control signal is within a third duty cycle range.

11. The system according to claim 10, wherein the third duty cycle range is outside of both the first duty cycle range and the second duty cycle range.

12. The system according to claim 11, wherein the third duty cycle range is greater than about 99% duty cycle.

13. The system according to claim 11, wherein the third duty cycle range is less than about 1% duty cycle.

14. The system according to claim 10, wherein the motor driver is configured to disable the motor, if the duty cycle of the control signal is within a fourth duty cycle range.

15. The system according to claim 14, wherein the fourth duty cycle range is outside both of said first duty cycle range and the second duty cycle range.

16. The system according to claim 15, wherein the fourth duty cycle range is less than about 1% duty cycle.

17. The system according to claim 15, wherein the fourth duty cycle range is greater than about 99% duty cycle.

18. A method of controlling the position of a throttle assembly using a single signal, comprising:

providing a throttle assembly having a throttle plate coupled to a motor;

generating a single control signal having a magnitude, direction, and disable component;

receiving the control signal in a motor driver;

controlling the position of the throttle plate by driving the motor with the motor driver; and wherein the magnitude component corresponds to an amount of change in throttle position, the direction component corresponds to a direction of the change in the throttle position, and the disable component provides the ability to disable the motor.

19. The method according to claim 18, wherein the magnitude component of the control signal is based on a duty cycle range.

20. The method according to claim 18, wherein the direction component of the control signal is based on a duty cycle range.

21. The method according to claim 18, wherein the disabled component of the control signal is based a duty cycle range.

22. The method according to claim 18, further comprising driving the motor in a first direction, if the control signal has a duty cycle within a first duty cycle range.

23. The method according to claim 22, further comprising driving the motor in a second direction, if the control signal has a duty cycle within a second duty cycle range.

24. The method according to claim 23, wherein the second duty cycle range contains a lowest duty cycle that is greater than a highest duty cycle included in the first duty cycle range.

25. The method according to claim 22, wherein the first duty cycle range is about 1–50% duty cycle.

26. The method according to claim 22, wherein the second duty cycle range is about 50–99% duty cycle.

27. The method according to claim 22, further comprising disabling the motor, if the duty cycle of the control signal is within a third duty cycle range.

28. The method according to claim 27, wherein the third duty cycle range is outside of both the first duty cycle range and the second duty cycle range.

29. The method according to claim 28, wherein the third duty cycle range greater than about 99% duty cycle.

30. The method according to claim 28, wherein the third duty cycle range is less than about 1% duty cycle.

31. The method according to claim 27, further comprising disabling the motor, if the duty cycle of the control signal is within a fourth duty cycle range.

32. The method according to claim 31, wherein the fourth duty cycle range is outside both of said first duty cycle range and the second duty cycle range.

33. The method according to claim 32, wherein the fourth duty cycle range is less than about 1% duty cycle.

34. The method according to claim 32, wherein the fourth duty cycle range is greater than about 99% duty cycle.

* * * * *